US005584381A

United States Patent [19]

Brundage et al.

[11] Patent Number: 5,584,381

[45] Date of Patent: Dec. 17, 1996

[54] ILLUMINATED ROCKER BUTTONS WITH LIGHT DAMS

[75] Inventors: Douglas L. Brundage, Harvest, Ala.; Dewayne E. Green, Winchester, Tenn.; Charles Wright, Decatur, Ala.

[73] Assignee: Chrysler Corporation, Auburn Hills, Mich.

[21] Appl. No.: 356,001

[22] Filed: Dec. 14, 1994

[51] Int. Cl.[6] ..... H01H 9/00

[52] U.S. Cl. ..... 200/315; 200/313; 200/561

[58] Field of Search ..... 200/315, 313, 200/312, 311, 310, 339, 553, 292, 293, 554–563

[56] References Cited

U.S. PATENT DOCUMENTS 4,013,857 3/1977 Tanaka ..... 200/315
4,135,073 1/1979 Kobayashi ..... 200/313
4,929,804 5/1990 Kawai et al. ..... 200/553
5,107,082 4/1992 Valenzona ..... 200/315

*Primary Examiner*—David J. Walczak
*Attorney, Agent, or Firm*—Christopher A. Taravella

[57] ABSTRACT

Rocker buttons for devices such as automotive audio systems are mounted in escutcheons of the audio systems by using rocker frame members. Light dams, unitary with the rocker frame members shield LEDs used to illuminate indicia in the rocker buttons so that the light is not transmitted through gaps between the rocker buttons and the edges of openings through the escutcheons which receive the rocker buttons. Trunions extend laterally from the rocker buttons and are received within bearings formed by grooves in the escutcheons. In accordance with one embodiment of the invention, the rocker frames retain trunions in the bearings and in accordance with another embodiment of the invention peripheral display lenses overlie the trunions to hold the trunions in the bearings.

8 Claims, 6 Drawing Sheets

ILLUMINATED ROCKER BUTTONS WITH LIGHT DAMS

The present invention relates to illuminated rocker buttons with light dams. More particularly, the present invention relates to illuminated rocker buttons with light dams which are of interest in the automotive industry generally and are particularly useful in automotive radios.

BACKGROUND OF THE INVENTION

Modern automobiles have a plethora of buttons for controlling various accessories and automotive functions. As the number of buttons increases, it is necessary to identify each button to drivers and passengers so as to avoid confusion. In addition, as the number of buttons increases, space constraints and ergonomic considerations have resulted in indicia being placed on the buttons themselves. Since automobiles are driven at night as well as during the day it is, of course, preferable to illuminate the indicia so as to be readily seen and understood at a glance by a driver or passenger. By illuminating indicia, mistakes and confusion may be avoided which enable the driver to more easily concentrate his or her attention on driving the automobile instead of being distracted by other concerns.

When illuminating rocker buttons, it is highly desirable to avoid leakage of light around the button. If all of the light emitted by a rocker button is transmitted only through the indicia, then it is more likely that the button will function as an accurate target. Moreover, light leaks over an entire instrument panel may create a blurring effect which results in confusion that adds to driver irritation and dissatisfaction. Accordingly, manufacturers use flexible seals to isolate light sources so that the light sources project light only through the rocker button indicia.

The current practice of using resilient seals is relatively expensive due to relatively high tooling costs, piece costs and assembly costs. In addition, flexible seals result in numerous misbuilds due to seal misalignment. Since there are millions of rocker buttons with illuminated indicia, elimination of resilient light seals while retaining their function in other structures would result in considerable savings in production costs. One accessory, which utilizes rocker buttons in the form of rocker buttons with light seals is the car radio. A car radio may have more than one rocker button and if a rocker button leaks light or is improperly seated, then as assembled radio must be disassembled and the rocker button repaired or replaced before the radio can be shipped. Accordingly, increasing the reliability of light seals on rocker buttons used with radios will result in savings in the production costs of vehicles. The problems occurring in light seals in radio rocker buttons are exemplary of the light seal problem for other rocker buttons which an instrument panel or other rocker button panel, such as a window operating panel, might employ.

SUMMARY OF THE INVENTION

It is a feature of the present invention to provide a new and improved light seal arrangement especially useful with rocker buttons.

The present invention is directed to a combination including an escutcheon having an opening therethrough and a rocker button mounted in the opening, which rocker button effects electrical connections on a printed circuit board located behind the escutcheon. The printed circuit board has a light source thereon which directs light through an indicia lens in the rocker button. The combination is improved by a rocker frame aligned with the opening through the escutcheon and fixed with respect to the escutcheon and printed circuit board. The rocker frame has a light dam disposed therein which is aligned with and isolates the light source on the printed circuit board from the surrounding area enclosed by the rocker frame so that only the indicia lens is illuminated by the light source. A pair of trunions extend laterally of the rocker button defining an axis of rotation for the rocker button. Bearings formed in the escutcheon proximate the opening therethrough journal the trunions of the rocker button in the escutcheon.

In accordance with a first embodiment of the improvement, a relieved area is formed in the escutcheon around the opening therethrough. The relieved area receives a display lens which fits over the trunions of the rocker button to hold the rocker button journaled in the bearings formed in the escutcheon.

In accordance with another embodiment of the invention, the rocker frame is molded separately from the escutcheon and is assembled therewith. In the second embodiment, an edge of the frame encloses the bearings in the escutcheon to retain the trunions.

BRIEF DESCRIPTION OF THE DRAWINGS

Various other objects and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
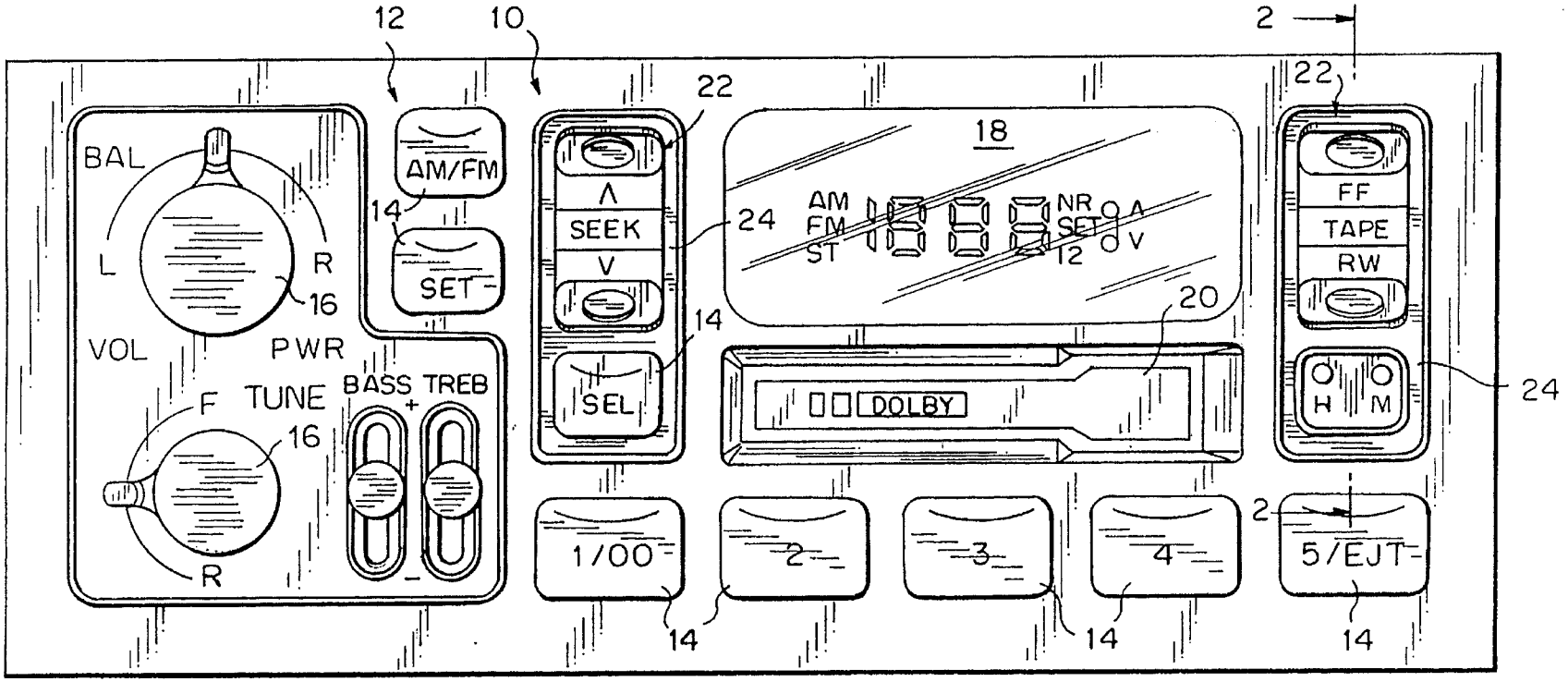
FIG. 1 is a front view of a radio face configured in accordance with the principles of the instant invention.

Referring now to FIG. 1, there is shown a face 10 of an automotive radio, which includes an escutcheon 12 and a plurality of buttons 14 and knobs 16, a display 18 and a tape slot 20. Also mounted on the echelon are rocker button assemblies 22 configured in accordance with the principles of the present invention. In accordance with a first embodiment of the invention as illustrated in FIG. 1, the rocker button assemblies 22 are mounted in and are surrounded by display lenses 24.

Figure 2:
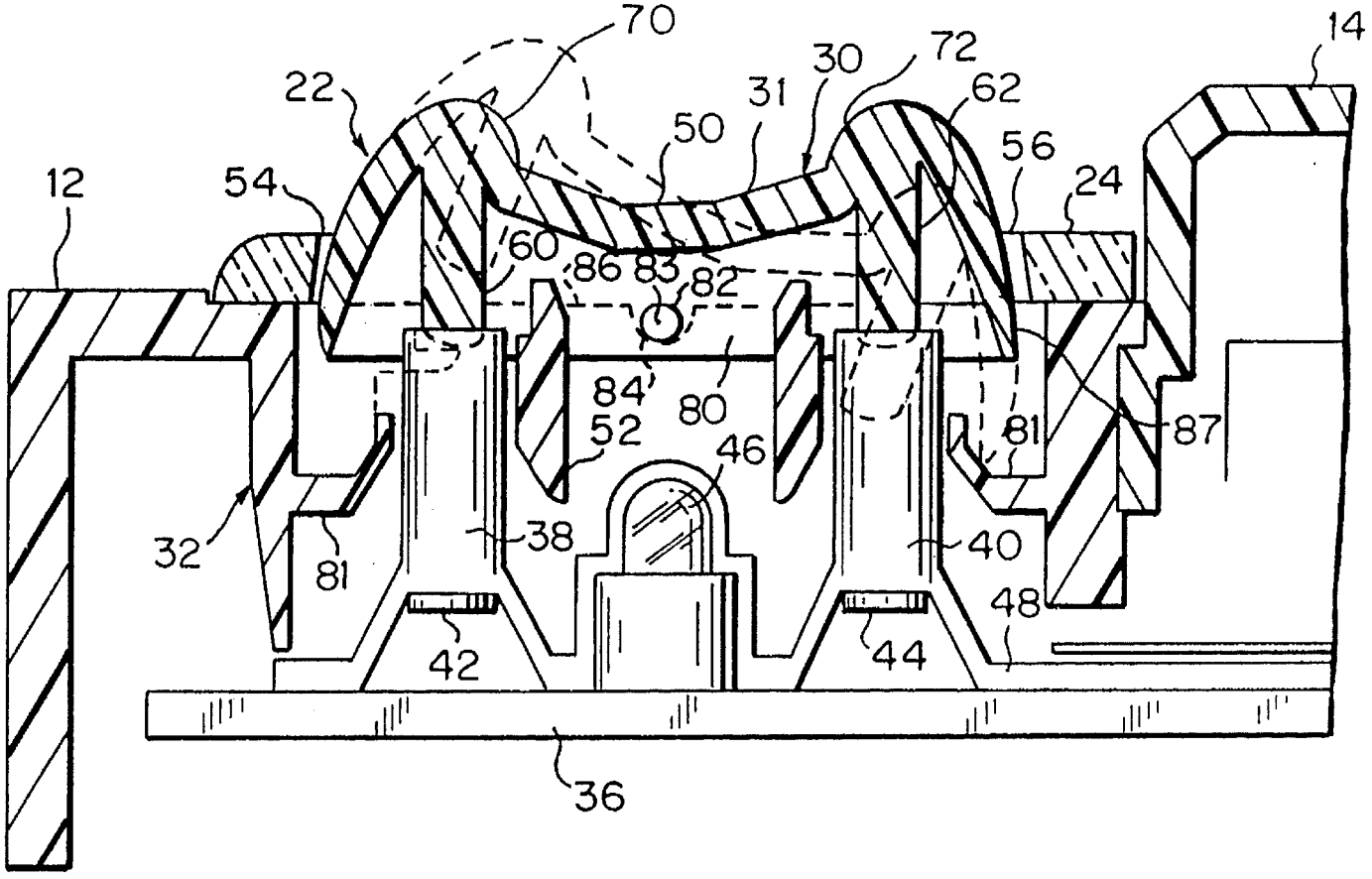
FIG. 2 is an elevational view taken along lines 2—2 of FIG. 1 showing a first embodiment of the invention.
Figure 3:
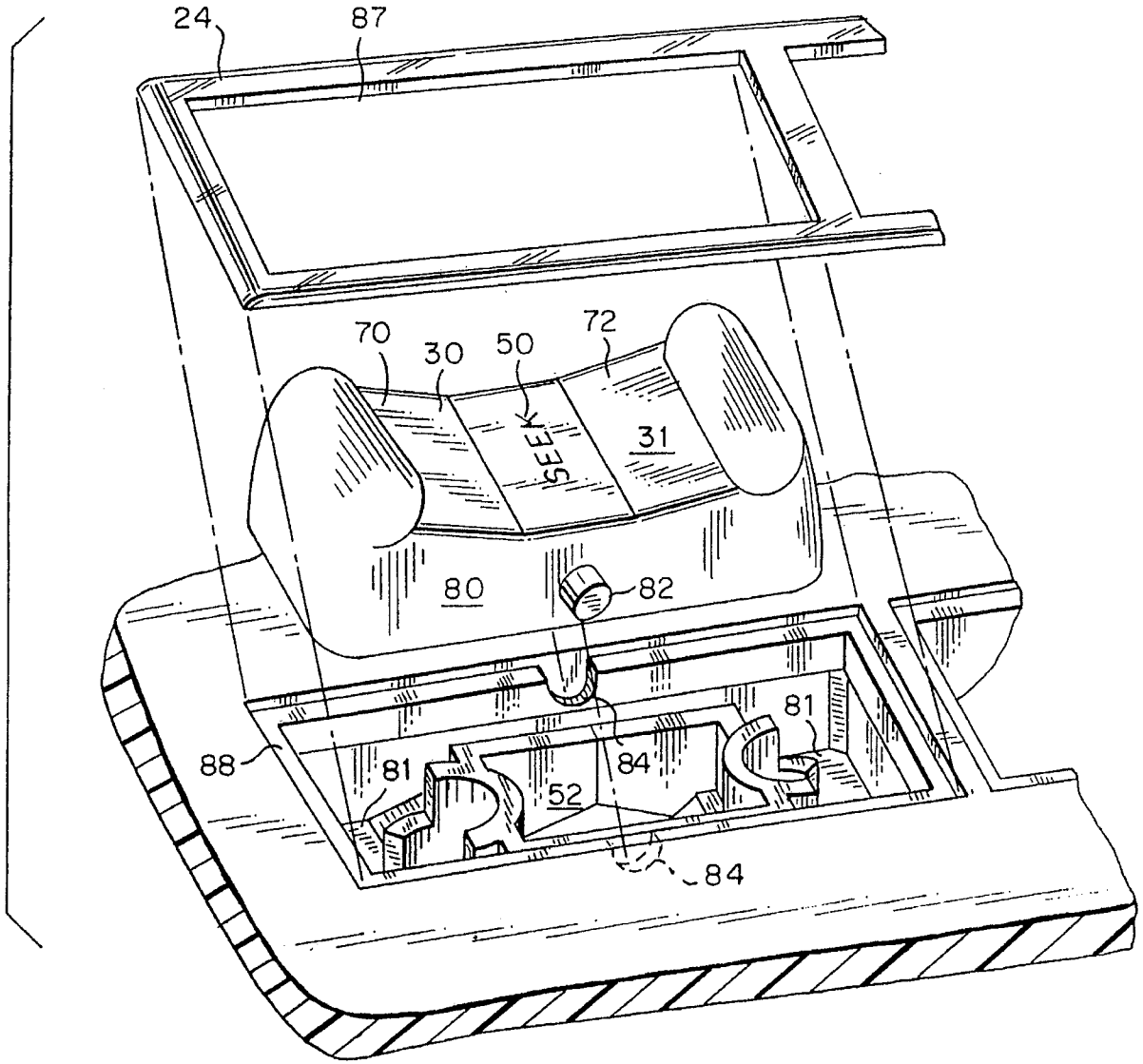
FIG. 3 is an exploded prospective view of a rocker button and rocker frame configured in accordance with the first embodiment, as viewed from in front of the button and frame.

Referring now to FIGS. 2 and 3, where the rocker button assembly 22 is shown in side elevation, it is seen that the rocker button assembly includes a rocker button 30 with a face 31 and rocker frame 32. In the first embodiment, the rocker frame is unitary with the escutcheon 12 (as opposed to being integral with the escutcheon as in FIGS. 4–6). The rocker frame 32 and button 30 are aligned with a printed circuit board 36, having first and second resilient push buttons 38 and 40 mounted thereon, which include contacts 42 and 44, respectively for bridging circuit terminals (not shown) on the printed circuit board 36 in a conventional fashion. Disposed between the push buttons 38 and 40 is an LED lamp 46. In assembling the radio 10, the escutcheon 12 is mounted over the printed circuit board 36 and in abutment with an elastomer key pad 48. The escutcheon 12 is then held fixed with respect to the key pad 48.

The button 30 has a lens 50 therein, which is transparent or translucent so as to transmit light from the LED 46 through the button face. The lens 50 is configured to display indicia, such as for example, the words "SEEK" or the word "TAPE" as is illustrated in FIG. 1. In accordance with the principles of the present invention, a light dam 52, which is rectangular in cross section, is disposed between the indicia lens 50 and the LED 46 to prevent light from leaking around the edges of the button 30. In other words, the light dam 52 forms a light tunnel open only at both ends which prevents light from the LED 46 from being transmitted through the spaces 54 and 56 adjacent rocker button 30.

The rocker button 30 includes two projections 60 and 62 which are aligned with push buttons 38 and 40. Preferably, the projections 60 and 62 are received within indentations or hollow cores 64 and 66 in the push buttons 38 and 40. In the illustrated embodiment, the push buttons 38 and 40 are made of the same elastomer material as the elastomer key pad 48 and deformed upon pressing either a first finger pad 70 or a second finger pad 72 on the face 31 of the rocker button 30. Finger pads 70 and 72 are not only continuous across the face 31 of the rocker button 30, but are continuous with a skirt 80 confined within the rocker frame 32. The frame includes ledges 81 which serves as a stop when engaged by the skirt 80 (see the dotted line position of the rocker switch 30). The rocker switch 30 can, of course, be pressed to establish an electrical connection with either the contact 42, by pressing on finger pad 70, or the contact 44 by pressing on finger pad 72.

As is readily apparent from FIGS. 2 and 3, the rocker button 30 includes a pair of laterally extending trunions 82 aligned with axis 83, which are received in bearings 84 formed in a surface of a rectangular indentation 86 in the escutcheon 12. The display lens 24 fits over the trunions 82 with the button 30 projecting through a rectangular opening 87 in the lens 24 to hold the trunions 82 in the bearings 84. The lens 24 is bonded or otherwise fixed in the rectangular indentation 88 of the escutcheon 12.

Figure 4:
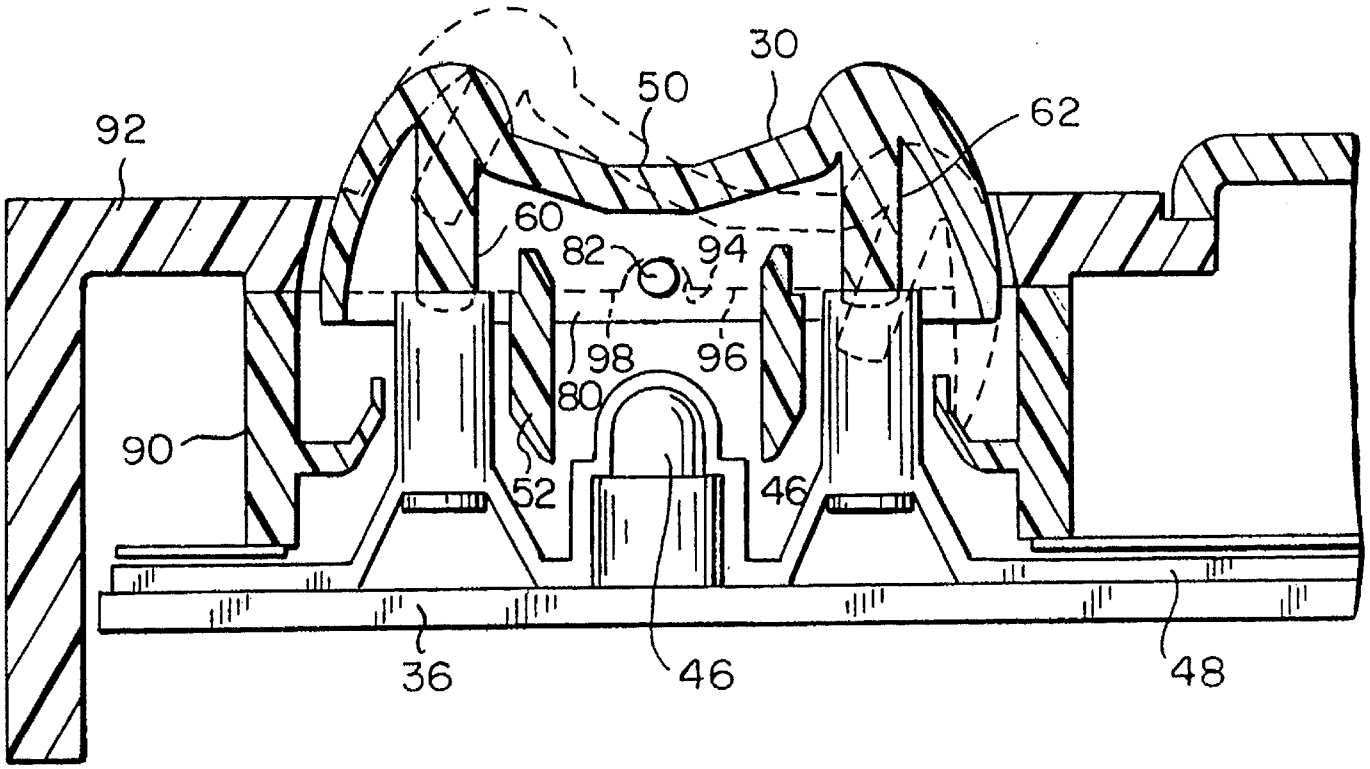
FIG. 4 is an elevational view illustrating a second embodiment of the second invention.
Figure 5:
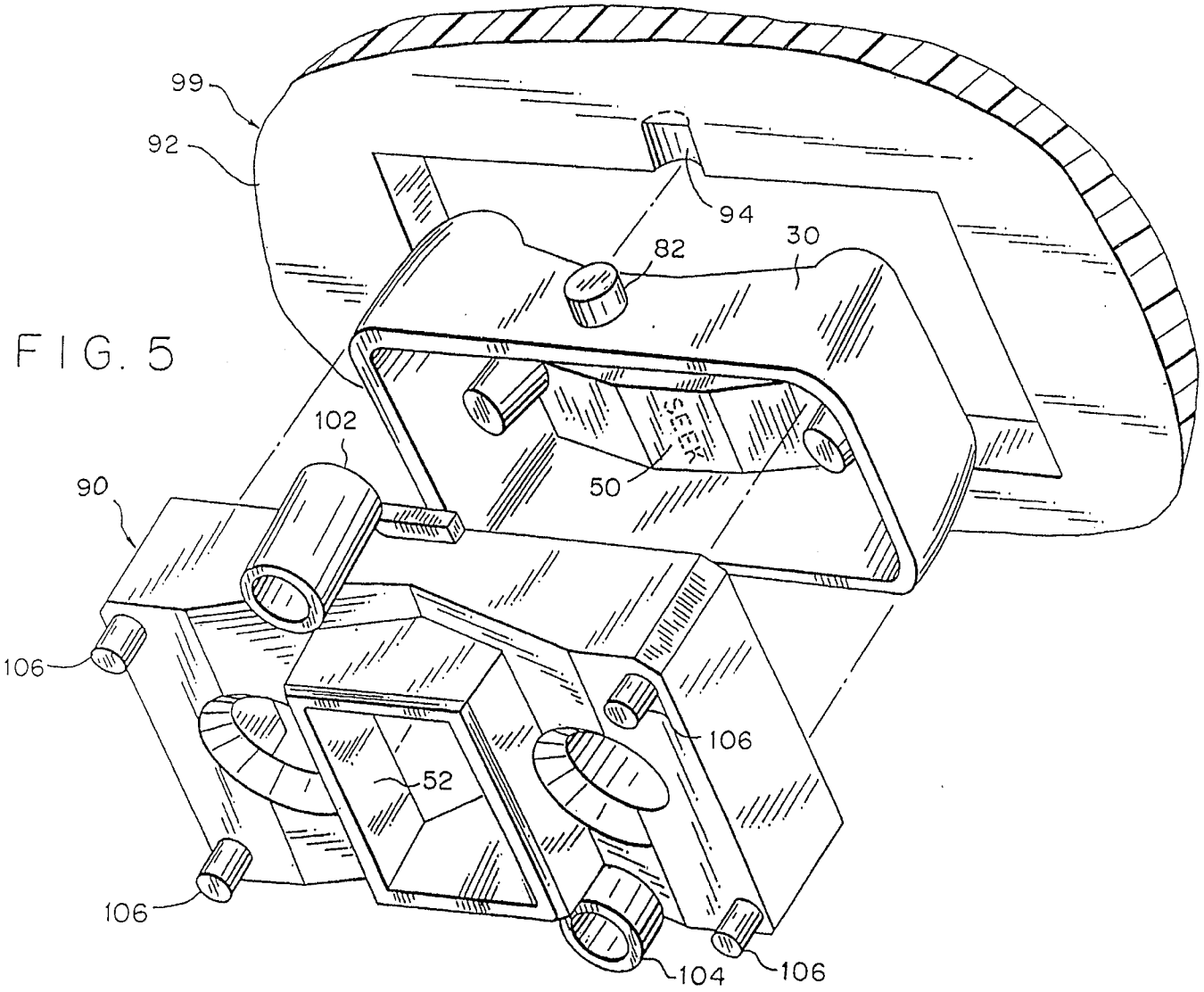
FIG. 5 is an exploded view of the rocker button, rocker frame and escutcheon of FIG. 4, as viewed from the back thereof.
Figure 6:
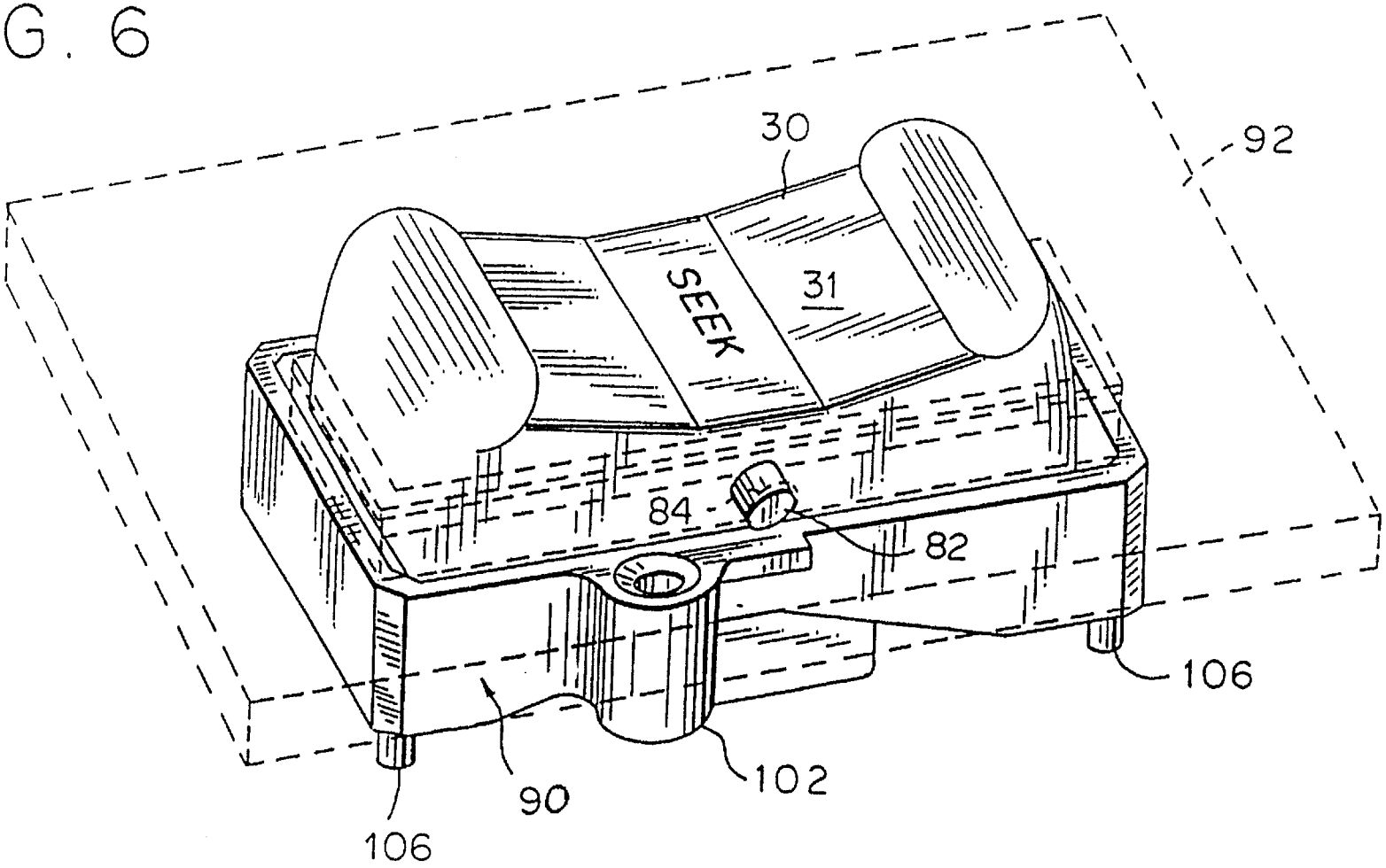
FIG. 6 is a prospective view of the rocker button and rocker frame of FIG. 4 assembled with an escutcheon shown in dotted lines.

Referring now to FIGS. 4–6 where a second embodiment of the invention is illustrated, similar reference numerals identify similar structures. (Circuit board 36, elastomer key pad 48, push buttons 38 and 40 are essentially the same in FIGS. 2–3 and FIGS. 4–6.) The push button 30 is also configured substantially the same in both embodiments; however, in the second embodiment, the rocker frame identified now with reference numeral 90 differs from the rocker frame 32 in that the rocker frame 90 is not unitary with the escutcheon 92. In the second embodiment of FIGS. 4–6, there is no display lens 24 to hold the rocker button 30 in position on the escutcheon 92. Rather, the separate rocker frame 90 engages the trunions 82 on the rocker button 30 to retain the trunions in bearings 94 formed in the escutcheon 92 when the edge surface 96 of the rocker frame 90 engages the back surface 98 of the escutcheon frame 92.

In the second embodiment shown in FIGS. 4–6, a pair of protrusions 100 and 101 having holes 102 and 104 for screws (not shown) are provided for fixing the rocker frame 90 to the printed circuit board 36 (see FIG. 4). Pins 106 extending from the bottom of the rocker frame 90 are received in locating holes through the elastomer of the key pad 48.

In the first embodiment of the invention, represented by the rocker button assembly 22, and in the second embodiment of the invention, represented by the rocker button assembly 22, isolation of the light source 46 is achieved without resort to a separate flexible light seal which is necessary in the configurations of the prior art. This is because light dams 52, which are unitary with the rocker frames 32 and 90 of the first and second embodiments of the invention isolate light from the LED 46 for transmission through the indicia lens 50.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a combination with an escutcheon having an opening therethrough, a rocker button mounted to said escutcheon and having first and second finger pads thereon and first and second projections extending therefrom, a printed circuit board having electrical connections thereon and located behind the escutcheon, first and second push buttons on the printed circuit board whereby the first push button is depressed by the first projection when the first finger pad is depressed to make electrical contact with the electrical connections on the circuit board and the second push button is depressed by the second projection when the second finger pad is depressed to make electrical contact with the electrical connections on the circuit board and a light source on the circuit board, the improvement comprising:

a rocker frame disposed in the opening through the escutcheon and fixed with respect to the escutcheon and printed circuit board, the rocker frame having a light dam disposed therein, the light dam being aligned with and isolating the light source on the printed circuit board from a surrounding area enclosed by the rocker frame;

an indicia lens in the rocker button, the indicia lens transmitting light from the light source through the indicia lens to illuminate a message at the surface of the rocker button;

a pair of trunions extending laterally of the rocker button defining an axis of rotation for the rocker button; and bearings formed in the escutcheon proximate the opening therethrough for journaling the trunions of the rocker button therein wherein the rocker button is biased to remain in a neutral position by the push buttons unless the first or second finger pads are pressed, whereby the light dam prevents light from the light source from reaching a gap between the rocker frame and the rocker button and the indicia lens of the rocker button is illuminated by the light source.

2. The improvement of claim 1 wherein a relieved area is formed in the escutcheon around the opening therethrough and wherein the relieved area receives a display lens which fits over the trunions of the rocker button to hold the rocker button journaled in the bearings formed in the escutcheon.

3. The improvement of claim 1, wherein the rocker frame is made of a separate piece from the escutcheon, and wherein an edge of the frame encloses the bearings in the escutcheon to retain the trunions journaled therein.

4. The improvement of claim 1, wherein the projections on the rocker button are disposed outside of the light dam.

5. The improvement of claim 1, wherein the light dam forms a light tunnel which is completely enclosed except at open ends thereof.

6. The improvement of claim 5, wherein the rocker button has a skirt defining a space beneath the rocker button, the skirt enclosing one end of the light tunnel formed by the light dam with the light source projecting through the other end of the light tunnel.

7. The improvement of claim 6, wherein the rocker frame includes ledges in back of the skirt which serve as stops engaging the skirt when the rocker button is pressed.

8. The improvement of claim 1, wherein the light source is an LED.

* * * * *